United States Patent [19]

Erana

[11] Patent Number: 4,899,802

[45] Date of Patent: Feb. 13, 1990

[54] SYSTEM FOR CHANGING AND CLEANING BLOWING PLATES IN CORE BLOWING MACHINES

[76] Inventor: Agustín A. Eraña, Zorrostea, 4 Poligono Ind. Ali. Giobs., Vitoria Alava, Spain, 01010

[21] Appl. No.: 317,615

[22] Filed: Mar. 1, 1989

[30] Foreign Application Priority Data

Mar. 25, 1988 [ES] Spain ..... 8800929

[51] Int. Cl.[4] ..... B22C 15/24; B22C 19/00; B22C 23/00

[52] U.S. Cl. ..... 164/158; 164/200; 164/228

[58] Field of Search ..... 164/158, 121, 200, 228

[56] References Cited

U.S. PATENT DOCUMENTS 4,083,396 4/1978 Michelson ..... 164/158

4,572,273 2/1986 Katashima ..... 164/158

FOREIGN PATENT DOCUMENTS 2193916A 2/1988 United Kingdom ..... 164/158

*Primary Examiner*—Richard K. Seidel
*Assistant Examiner*—J. Reed Batten, Jr.
*Attorney, Agent, or Firm*—Helfgott & Karas

[57] ABSTRACT

The system includes two platforms vertically movable along guides provided on a fixed support. A top platform is swingable between a horizontal position in which it superposes a lower platform, and a vertical position. A blowing plate is positioned on the top platform. The system is provided with a double catch which is selectively engageable with the bottom wall of the top platform when the latter is in the horizontal position, and with the fixed support when the top platform is in the pivoted-away position.

3 Claims, 3 Drawing Sheets

SYSTEM FOR CHANGING AND CLEANING BLOWING PLATES IN CORE BLOWING MACHINES

FIELD OF THE INVENTION

The present invention relates to improvements in foundry core blowing machines, and more specifically to systems for changing and cleaning the blowing plate under which the corresponding core box must be placed in the process for propulsing the sand used to conform such cores.

BACKGROUND OF THE INVENTION

As is well known, in core blowing machines, the supply of a strong stream of air under pressure causes sand and its corresponding additives, to be dragged from a cartridge containing the sand to the inside of a core box which has previously been positioned under a blowing plate provided with apertures suited to the core to be manufactured in order that the sand distribution reaches all the hollows, thereby conforming a perfect core.

In the light of the foregoing, it is clear that different types of cores will require a specific type of blowing plate, and therefore the plates must be removably assembled on the blowing machine, at the same time as throughout the operative stage of a specific blowing plate, sand residues which must be removed regularly are deposited thereon at each phase.

In order to attain this double objective there are known core blowing machines provided with a platform capable of receiving and fixing the blowing plates and which may swing, from a horizontal and working position, to a vertical position for the sand residues to be eliminated, by scraping the plate or by any other means.

In this respect reference should be made to U.S. Pat. No. 4,572,273 which describes a device provided with a swinging platform, the swinging movement whereof is provided by a pair of hydraulic cylinders. The platform is together with the cited hydraulic cylinders, connected to a travelling carriage, which may be displaced through vertical guides on a fixed support and with the collaboration of another hydraulic cylinder, so that this last hydraulic cylinder affords vertical displacement of the platform and consequently of the blowing plate and the core box with respect to the top blowing head, inherent in the normal operation of the core blowing machine, whereas the first pair of cylinders afford the swinging movement of the platform so that the blowing plate may be cleaned.

This device is moreover provided with a fourth hydraulic cylinder, positioned transversally, with which the blowing plate is attached or released with respect to the swinging platform.

This solution, albeit affording attainment of the objectives sought from an operative point of view, is extremely complex from a structural point of view and consequently expensive both as regards manufacture and subsequent maintenance thereof.

SUMMARY OF THE INVENTION

The improvements set out in the present invention fully solve above problem whilst maintaining an optimal operating performance, with full operating automatism, but with a considerably simpler and therefore cheaper structure, which makes the risk of breakdowns smaller.

More specifically, and in order to achieve the above, the improvements set out in the present invention reside in the provision of two superposed platforms, a lower platform which may be vertically displaced on guides operatively provided for such purpose, and another top platform which may swing with respect to the first platform and connected to the latter through a lateral joint. At the same time the two platforms may be connected to each other, in the area opposite to the joint, through a double catch actuated by a small cylinder which determines two positions therefor, namely a first position in which the catch, swingingly supported on the lower platform, engages a lower projecting abutment of the swinging or top platform which receives the blowing plate, and a second position in which the catch is released from such abutment and engages another abutment of the fixed and lower support. This exceedingly simple structure allows the use of a single hydraulic cylinder, and when the two platforms are fixed to each other the single cylinder determines their joint elevation, and especially elevation of the top swinging platform whilst remaining in a horizontal position, in accordance with one of the services to be afforded by the device, whereas when the two platforms are released and the double catch connects the lower platform to the support, the actuation of the single hydraulic cylinder causes the top platform to swing, for which purpose said cylinder must evidently be assembled between the lower fixed support and the top swinging platform.

Complementarily, and as a further characteristic of the invention, in order to fix the blowing plate to the top swinging platform, during the cleaning operations when such platform swings, two catches are swingingly joined to opposite areas of the platform. The catches may block the blowing plate against the swinging platform and which normally tend towards this position due to the effect of respective springs which assist the catches. The lower end of each of the catches is further provided with two rollers projecting substantially from the lower surface of the swinging platform. The two rollers or block sheaves, when the top platform swings onto the lower platform, i.e., when the top platform adopts a horizontal position and consequently the catches are inoperative, since the blowing plate remains stable due to its own weight, fall upon abutments of the lower platform, formed in a slope, the catches being forced to swing towards an open position against the corresponding springs and, consequently, the blowing plate is released, so that the operations to change or substitute the same may be performed, without the necessity to perform any specific operation for this purpose, i.e., so that the blowing plate is disengaged, for this takes place automatically.

Finally, the top platform is provided with an abutment projecting from its lower base through which it rests on the lower platform when it attains a horizontal position. When the top platform is lowered, in a horizontal position, a shock absorbing abutment takes place preventing brusqueness in the contact of the previously mentioned real rest abutment.

The aforementioned objects, features and advantages of the invention will, in part, be pointed out with particularity, and will, in part, become obvious from the following more detailed description of the invention, taken in conjunction with the accompanying drawing, which form an integral part thereof.

DETAILED DESCRIPTION OF THE PREFERRED EMBODIMENT OF THE INVENTION

Figure 3:
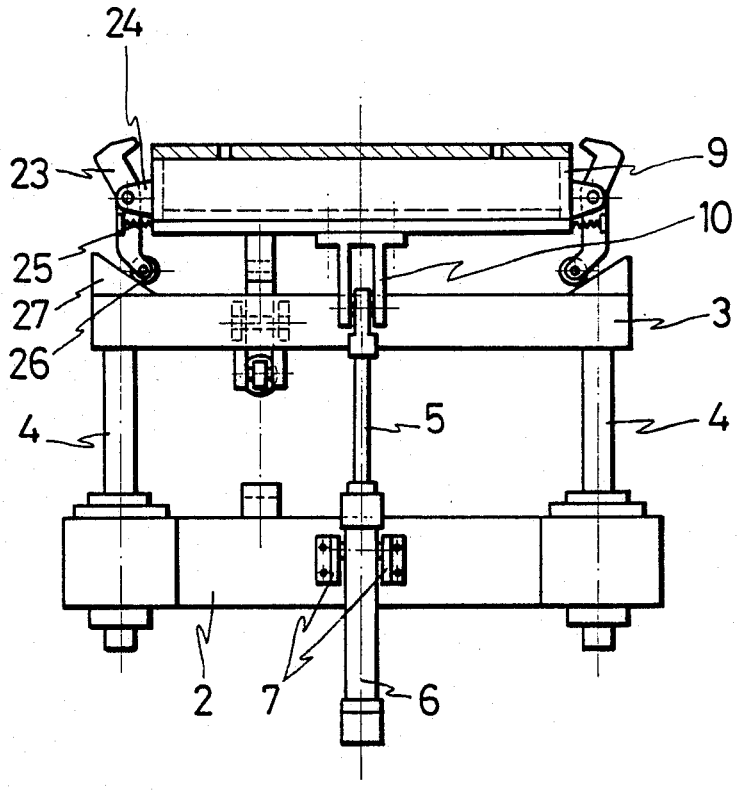
FIG. 3 is a detail of the front elevation view of the same device, in the working position shown in FIG. 1.

In the light of the figures of the drawings it may be observed that, in accordance with the improvements set out herein, a core blowing machine is provided, on the corresponding support columns 1, with a fixed support 2 with respect to which a platform 3 may be displaced with the assistance of a pair of side guides 4 which may be axially displaced on bearings mounted in vertical apertures provided in the ends of support 2. the platform 3 is materialised in a rectangular frame, which is traversed by a rod 5 of an actuating cylinder 6 swingingly assembled on support 2, through lugs 7, as may be specifically observed in FIG. 3, which rod in turn and through the swing joint 8 is connected to a top platform 9 provided for such purpose with another pair of lugs 10 for the swing joint, a blowing plate 11 being positioned on platform 9.

Top platform 9 is connected to lower platform 3 through a front joint 16, so that platform 9may swing with respect to platform 3, and may also accompany the latter during vertical displacements thereof.

Figure 1:
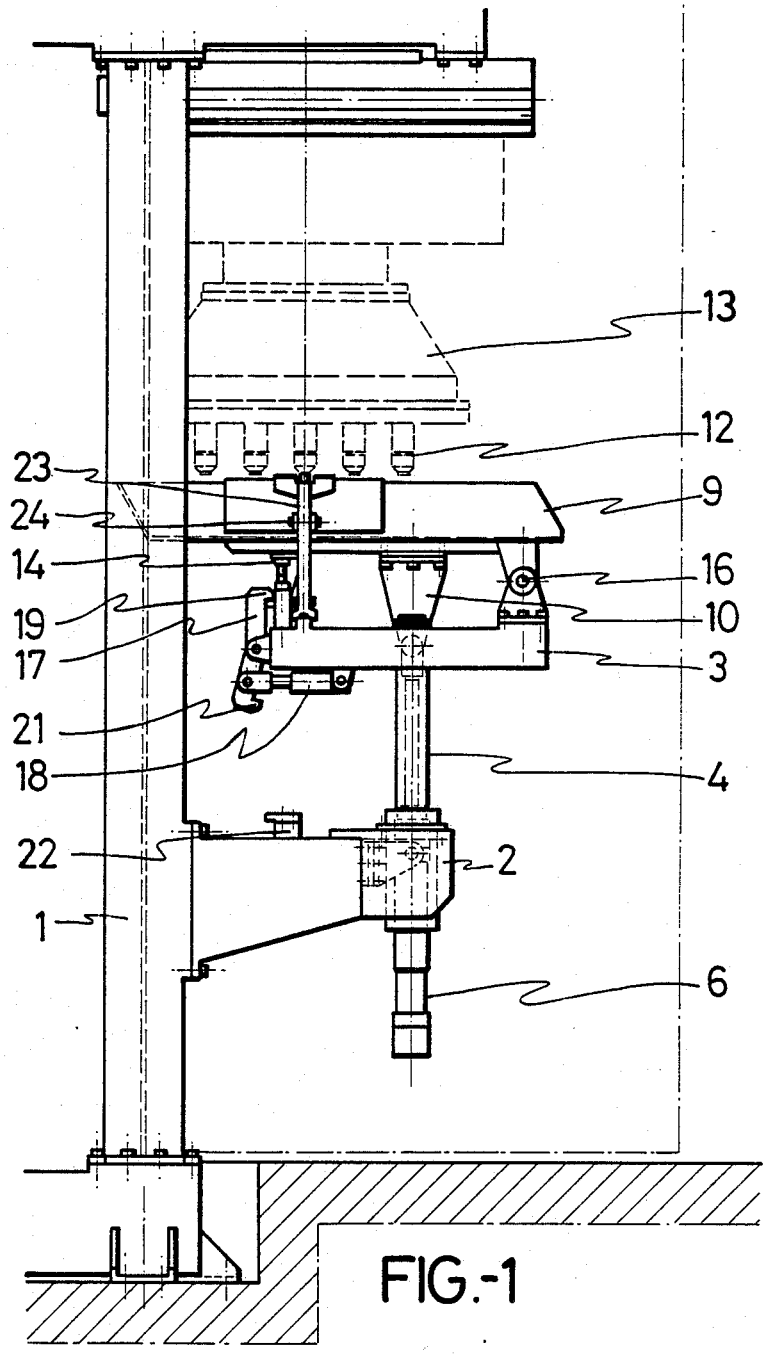
FIG. 1 is partial side elevation view of a core blowing machine, specifically the portion thereof which corresponds to the support and swinging devices of the blowing plate, which appear in a normal working condition of the machine, i.e., with the swinging platform in a horizontal position.
Figure 2:
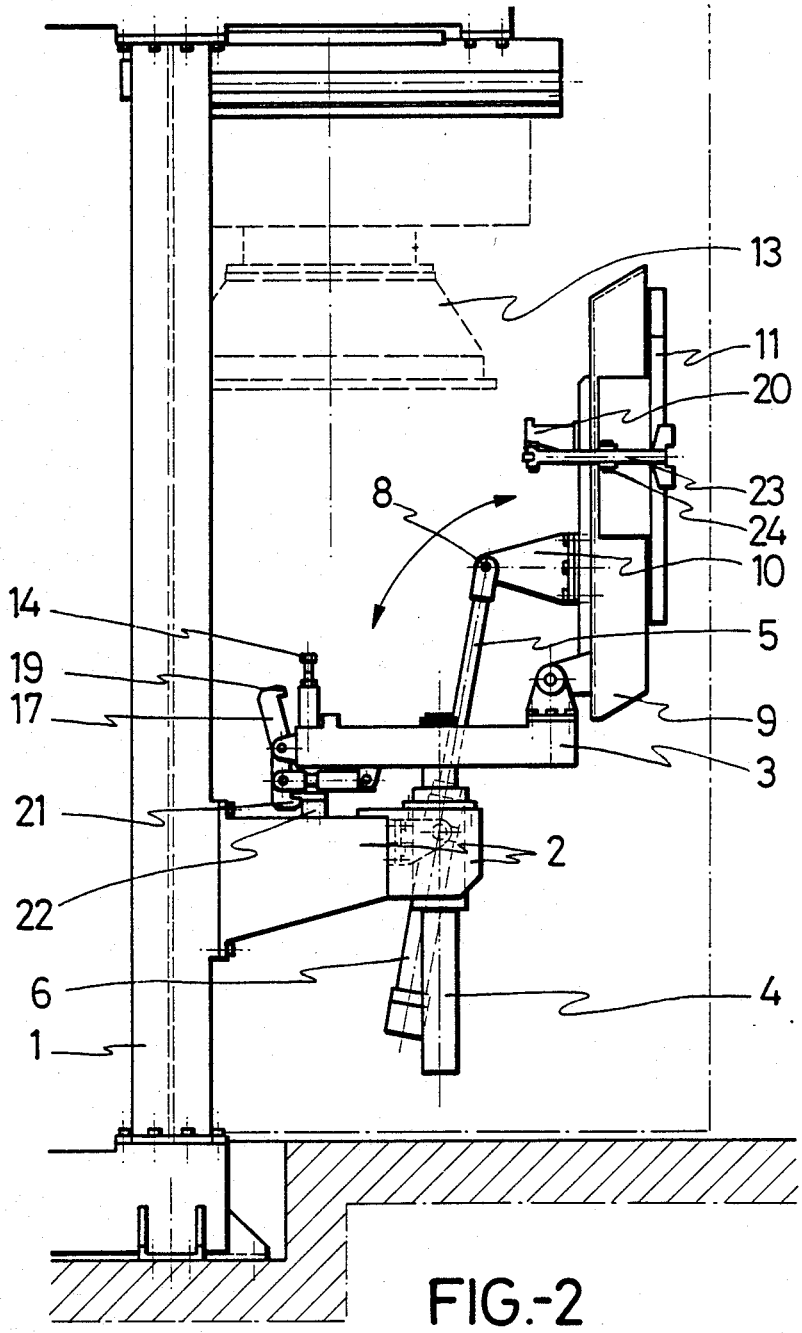
FIG. 2 is also a side elevation view of the assembly of the but showing the device collapsed for the top swinging platform, which position corresponds to the cleaning phase of the blowing plate.

In order that platform 9 may swing or ascend/descend vertically with the single actuating hydraulic cylinder 6, it has been foreseen that a double catch 17 actuated by a small cylinder 18 connected to platform 3 itself, is swingly joined to the edge of the lower platform 3 opposite the joint 16, as may be specifically observed in FIGS. 1 and 2, so that one of the operative ends of the double catch, generally referred to as 19, is complementary to an abutment 20 connected to the lower surface of swinging platform 9, whereas the other operative end of double catch 17, generally referred to as 21, in turn cooperates with an abutment 22 rigidly connected to support 2, either end 19 or 21 of double catch 17 therefore being operative depending on the position of cylinder 18.

In accordance with this structure, when cylinder 18 adopts the position shown in FIG. 1, catch 17 constitutes a connecting link between platforms 3 and 9, and therefore actuation of cylinder 6 causes the two platforms to be displaced together in an upward or downward direction, top and swinging platform 9 consequently remaining perfectly horizontal, which position is transmitted to blowing plate 11 connected to platform 9.

On the other hand, and from the lower limiting position of the two platforms and in an opposite actuation position of cylinder 18, double catch 17 connects lower platform 3 to support 2, whereby actuation of cylinder 6 in an expanding direction, as shown in FIG. 2, and immobilisation of lower platform 3, engaging abutment 20 of the support, causes top platform 9, and consequently blowing plate 11 attached thereto, to swing towards a vertical position which is also shown in figure 2, in which position it is easy to clean the plate 11, by scraping same or using any other means.

Attachment of blowing plate 11 to swinging platform 9 so that it does not become detached when in its cleaning position, takes place with the help of two side catches 23, swingingly assembled on platform 9 with the help of lugs 24 which project from the latter. Catches 23 tend towards a position of engagement for blowing plate 11 due to the effect of respective springs 25 and the lower ends whereof, i.e., the end opposite the end which forms the engaging catch itself, are provided with two rollers or block sheaves 26 with which engage abutments 27, acting as wedges which define slopes or inclined planes, provided on lower platform 3, whereby when swinging platform 9 is in a horizontal position, when such catches 23 are inoperative since the blowing plate remains stable on platform 9 due to its own weight, these catches release the plate 11 when they are forced to swing against their springs 25, and therefore the blowing plate 11 is automatically fully released in such position, so that it may be replaced.

Finally, it only remains to be said that lower displaceable platform 3 is obviously further provided, in the area opposite joint 16, with a shock absorbing abutment 14 upon which top swinging platform 9 rest when it reaches a horizontal position, thereby avoiding brusqueness when abutment 20 contacts its corresponding support.

Therefore, and in accordance with the structure described, while cylinder 18 remains in the position shown in FIG. 1, platform 9 will rise and descend whilst remaining horizontal, upon actuation of single driving cylinder 6, in a situation where catches 23 are inoperative wherefore the blowing plate 11 may be easily replaced, whereas when the cleaning position shown in FIG. 2 is desired; cylinder 18 only has to be actuated in an opposite direction so that, upon actuation of driving cylinder 6, the desired swinging movement is produced and, at the same time as such movement begins, and automatically, catches 23 adopt the operative blocking position of blowing plate 11 against swinging platform 9.

It is not considered necessary to extend the present description any further for one skilled in the art to understand the scope of the invention and the advantages derived therefrom.

The materials, shape, size and arrangement of the elements may vary, provided this does not imply a modification in the essentially of the characteristics of the invention.

The terms used to describe the present specification should be understood to have a wide and non-limiting meaning.

I claim:

1. A system for changing and cleaning blowing plates in core blowing machines, comprising a fixed support; a lower platform which is vertically displaceable with respect to said fixed support by means of a pair of vertical guides mounted to said support, a top platform which is laterally pivotally connected to the lower platform at one of its marginal areas so as to swing between a first horizontal position in which said top and lower platforms are superposed, and a second position in which said top platform is pivoted away from said lower platform, said top platform when in said horizontal position resting on a shock absorbent abutment provided on said lower platform; a double catch pivotally connected to said lower platform in an area opposite to said one of its marginal areas for blocking said top and lower platform to each other, said top platform having a bottom base provided with a first abutment, said fixed support being provided with a second abutment, means for actuating said double catch to pivot between two operating positions one of which is a blocking position for blocking said top and lower platform with one another and in which said double catch engages with said first abutment, and another position in which said catch is released from said first abutment and engages with said second abutment so as to permit said top platform to swing with respect to said lower platform, said swinging of said top platform being effected by a single driving hydraulic cylinder positioned between said fixed support and said top platform and extending through said lower platform towards said top platform, said hydraulic cylinder causing said top and lower platform to rise and descend together when said double catch blocks said platforms together and causing said swinging of said top platform when said double catch releases said top platform and engages said lower platform.

2. The system according to claim 1, wherein said actuating means includes a hydraulic cylinder smaller than said driving hydraulic cylinder.

3. The system according to claim 2, wherein said top platform is provided at two opposite sides thereof with two lateral catches for engaging a blowing plate to be positioned on said top platform, springs for biasing said lateral catches so that said lateral catches tend towards a locking position of said blowing plate on said top platform, said lateral catches having plate-engaging ends and opposite ends terminated with rollers, said lower platform having at two opposite ends thereof wedge-shaped abutments having inclined surfaces, said rollers cooperating with said inclined surfaces so that when said top platform is in said horizontal position said rollers come into contact with said inclined surfaces causing said lateral catches to swing in an opening direction whereas said top platform begins to swing to place said blowing plate to a cleaning position, said lateral catches automatically returning to said locking position to engage said plate due to action of said springs.

* * * * *